US011412328B2

(12) United States Patent
Kamimura

(10) Patent No.: US 11,412,328 B2
(45) Date of Patent: Aug. 9, 2022

(54) HEADBAND FOR HEADPHONE AND HEADPHONE COMPRISING THE SAME

(71) Applicant: JVCKENWOOD Corporation, Yokohama (JP)

(72) Inventor: Shinji Kamimura, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 16/868,347

(22) Filed: May 6, 2020

(65) Prior Publication Data

US 2020/0359133 A1 Nov. 12, 2020

(30) Foreign Application Priority Data

May 7, 2019 (JP) ..... JP2019-087376

(51) Int. Cl.
*H04R 25/00* (2006.01)
*H04R 5/033* (2006.01)
*H04R 1/10* (2006.01)

(52) U.S. Cl.
CPC ..... *H04R 5/0335* (2013.01); *H04R 1/1008* (2013.01)

(58) Field of Classification Search
CPC .... H04R 1/1008; H04R 5/0335; H04R 1/105; H04R 1/1066; H04R 1/1075; H04R 2201/10
USPC ..... 381/378
See application file for complete search history.

(56) References Cited

U.S. PATENT DOCUMENTS

| | | | | |
|---|---|---|---|---|
| 4,499,593 | A * | 2/1985 | Antle | H04R 1/1066 381/309 |
| 4,689,822 | A * | 8/1987 | Houng | H04R 1/1066 381/371 |
| 5,574,795 | A * | 11/1996 | Seki | H04R 5/0335 381/370 |
| 6,466,681 | B1 * | 10/2002 | Siska, Jr. | H04R 5/0335 381/370 |
| 9,467,767 | B2 * | 10/2016 | Chen | H04R 5/033 |
| 9,973,854 | B1 * | 5/2018 | Zimmer | A42B 3/30 |
| D857,654 | S * | 8/2019 | Levine | D14/205 |
| 2014/0177884 | A1 * | 6/2014 | Minarik | H04R 1/1041 381/309 |
| 2017/0071320 | A1 * | 3/2017 | Shing | H04R 5/0335 |
| 2017/0264992 | A1 * | 9/2017 | Wallace | H04R 1/1066 |
| 2017/0347194 | A1 * | 11/2017 | Nyegaard | H04R 1/1008 |
| 2018/0041827 | A1 * | 2/2018 | Abdelmalek | H04R 1/1066 |
| 2018/0146292 | A1 * | 5/2018 | Wahlin | H04R 5/0335 |

FOREIGN PATENT DOCUMENTS

JP 2017-98869 A 6/2017

* cited by examiner

*Primary Examiner* — Phylesha Dabney
(74) *Attorney, Agent, or Firm* — Nath, Goldberg & Meyer; Jerald L. Meyer

(57) ABSTRACT

A headband for headphones includes: a band base portion including a U-shaped cross section forming a slit opened on a side surface of the band, the band having a first flexural rigidity; and a supporter detachably attached into the slit, formed into an arc shape and having a second flexural rigidity larger than the first flexural rigidity.

14 Claims, 5 Drawing Sheets

HEADBAND FOR HEADPHONE AND HEADPHONE COMPRISING THE SAME

CROSS REFERENCE TO RELATED APPLICATIONS

This application is based on and claims priority from Japanese Patent Application No. 2019-087376, filed on May 7, 2019, the entire contents of which are incorporated by reference herein.

BACKGROUND

The present disclosure relates to a headband for a headphone, and a headphone comprising the same.

Japanese Patent Application Laid-Open Publication No. 2017-098869 (Patent Document 1) describes a headphone provided with a headband which is capable of adjusting a lateral pressure applied to a head when using the headphone. The headphone has a headband having a leaf spring curved to a shape corresponding to the head of the user, an adjustment member arranged outside the leaf spring to adjust a distance between both ends of the leaf spring, and a position adjusting mechanism for adjusting a position of the adjustment member.

The headphone described in Patent Document 1 enables the user to adjust the lateral pressure by adjusting the position of the adjustment member with the position adjusting mechanism to change the distance between both ends of the leaf spring.

SUMMARY

In many mass retailers, customers can listen with various headphones and can purchase a selected headphone having the desired sound quality. In this regard, so-called overhead type headphone having a headband biases the temporal of the customer at a lateral pressure while wearing the headphone on his or her head. The lateral pressure changes depending on each headphone and on each size and shape of the head of the customer.

Even if customers would like the sound quality of the headphone by their listening, they would give up buying it when the lateral pressure is uncomfortable. This means that the lateral pressure of the headphone has been required to be adjustable for the customer's preference.

From this viewpoint, the headband of the headphone described in Patent Document 1 has a desirable structure. However, it has many components and the structure is complicated. Therefore, the manufacturing cost becomes high and there are many restrictions on the appearance design.

An object of the present disclosure is to provide a headband for a headphone and a headphone including the headband, which can adjust the lateral pressure, suppress an increase of the manufacturing cost, and provide a high degree of freedom in appearance design.

The present disclosure provides a headband for headphones including: a band base portion including a U-shaped cross section forming a slit opened on a side surface of the band, the band having a first flexural rigidity; and a supporter detachably attached into the slit, formed into an arc shape and having a second flexural rigidity larger than the first flexural rigidity.

The present disclosure provides a headphone including: main bodies each housing a speaker unit; and the aforementioned headband linking between the main bodies.

According to the present disclosure, it is possible to provide a headband for a headphone and a headphone including the headband, which can adjust the lateral pressure, suppress an increase of the manufacturing cost, and provide a high degree of freedom in appearance design.

DETAILED DESCRIPTION

Hereinafter, a headphone 91 according to an embodiment of the present disclosure will be described.

Figure 1:
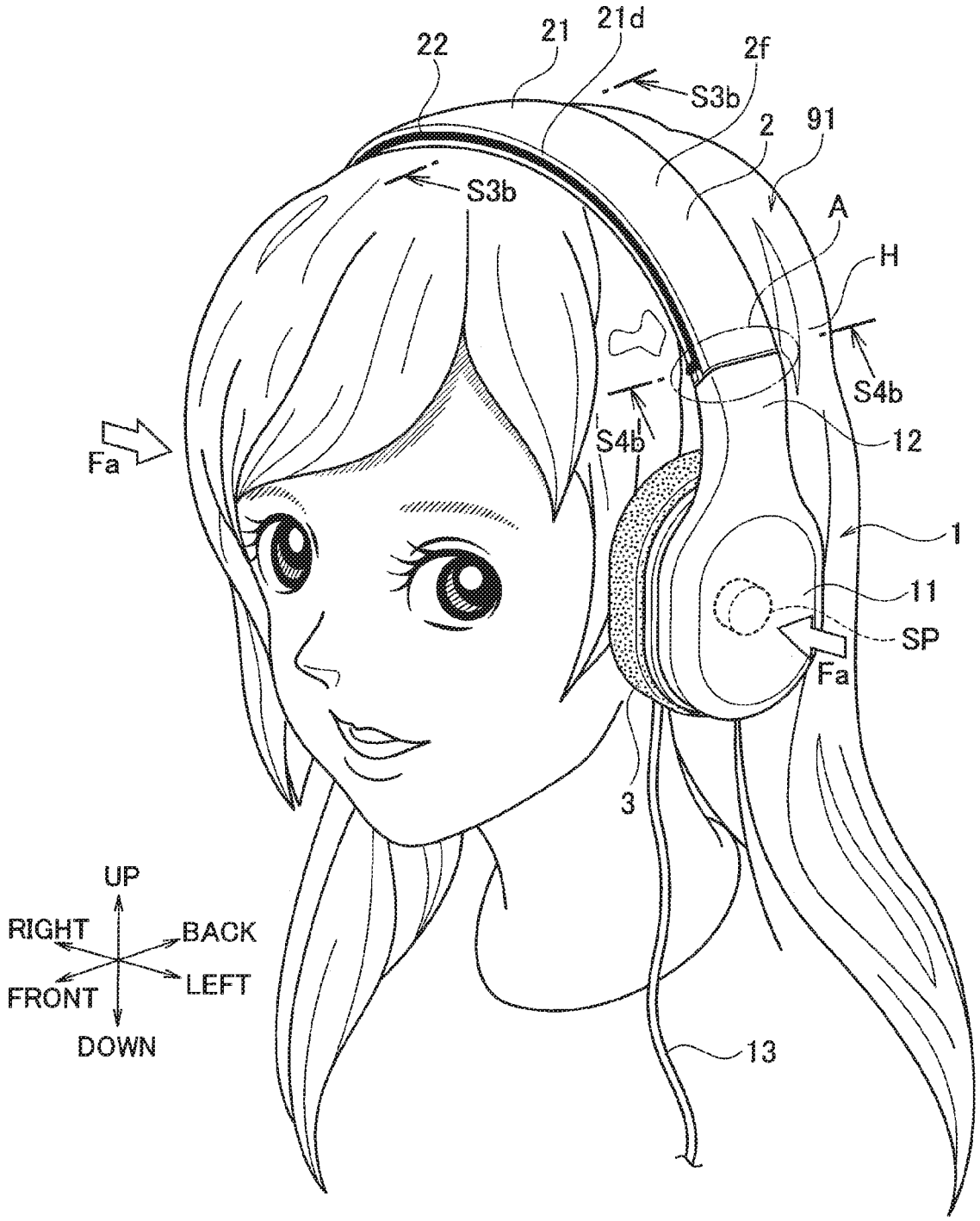
FIG. 1 is a perspective view of a headphone according to an embodiment of the present disclosure while being worn on a head.

FIG. 1 is perspective view of a headphone 91 according to an embodiment of the present disclosure while being worn on a head H of a user. In the following description, each direction of front, back, right, left, up and down is defined by arrows shown in FIG. 1.

The headphone 91 includes a pair of main bodies 1 and 1. One of the main bodies is for a right ear and the other of them is for a left ear. The headphone 91 further includes a band 2 as a headband for the headphone 91. The band 2 links (connects) between one main body 1 and another main body 1. Since FIG. 1 is a perspective view, it shows only the left one of the main bodies 1 and 1.

The main body 1 includes a housing 11 and a speaker unit SP housed in the housing 11. The housing 11 is formed into a cup having substantially hemispherical or vertically-elongated spherical shape, for example.

A pad 3 may be attached to the housing 11 on the side facing to the head H. The pad 3 has softness and can touch the temporal of the head H when the headphone. 91 is worn on the head H.

The band 2 can elastically spreads, for example, when the headphone 91 is worn on the head H. In other words, the band 2 can be elastically deformed so that the both ends are further separated from each other. Therefore, when the headphone 91 is worn on the head H, an elastic repulsive force is generated by the elastic deformation of the band 2. The main body 1 presses the temporal of the head H with the elastic repulsive force in a direction as shown by the arrow Fa. This pressure with the main body 1 applied to the temporal is referred to a "lateral pressure".

The housing 11 has a band connection portion 12 projecting upward (i.e. toward an end of the band 2) from the housing 11. The band connection portion 12 is connected with the end of the band 2. Signal cables 13 are pulled out from the lower portions the main bodies 1 and 1. FIG. 1 shows only the left one of the signal cables 13. One end of each signal cable 13 is electrically connected to the corresponding speaker unit SP. The other ends of the signal cables 13 are bundled into a single cable and connected to a stereo plug (not shown). By the connection of the stereo plug to a music player or the like, sounds are outputted from both speaker units SP and SP. The headphone 91 may be configured as a wireless headphone. In this case, the headphone 91 at least includes a wireless receiver (not shown) receiving signals relating sound. Instead, the aforementioned signal cables 13 are omitted.

The band 2 includes a band base portion 21 and a supporter 22 attached to the band base portion 21. As described below, the supporter 22 is detachably (exchangeably) attached (fitted) into a slit 21*a* of the band base portion 21.

Figure 2A:
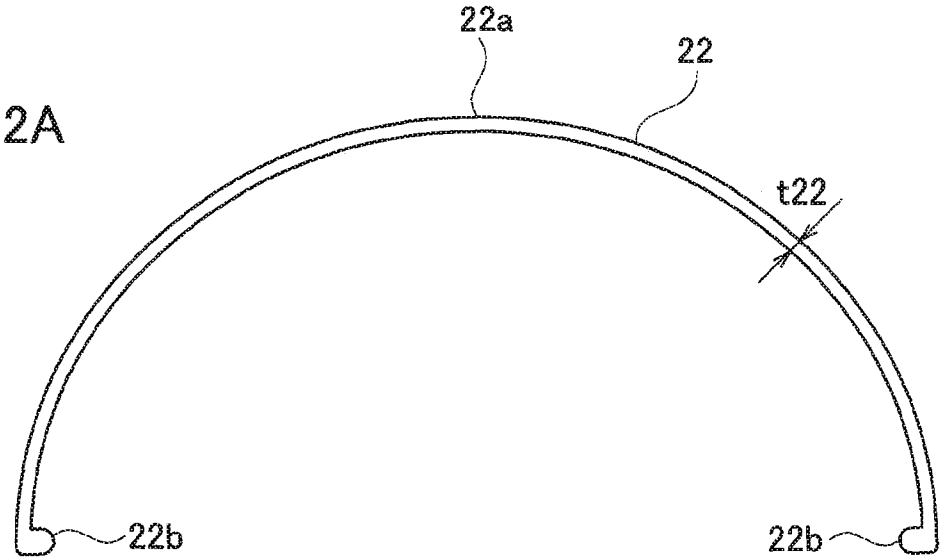
FIG. 2A is a front view of a supporter according to an embodiment of the present disclosure.
Figure 2B:
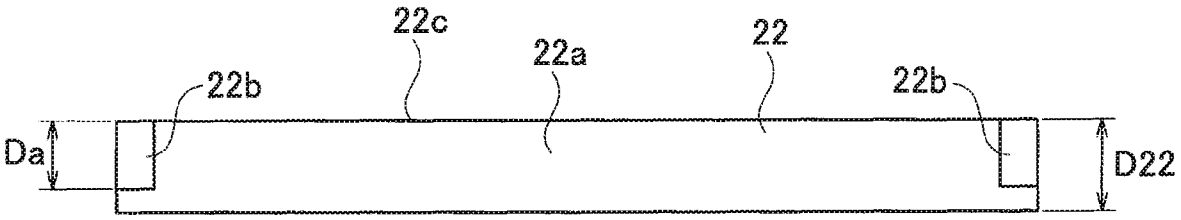
FIG. 2B is a bottom view of the supporter.
Figure 2C:
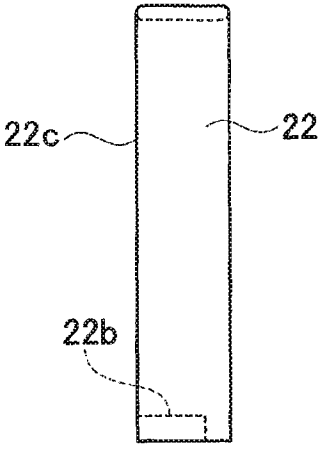
FIG. 2C is a right side view of the supporter.
Figure 3A:
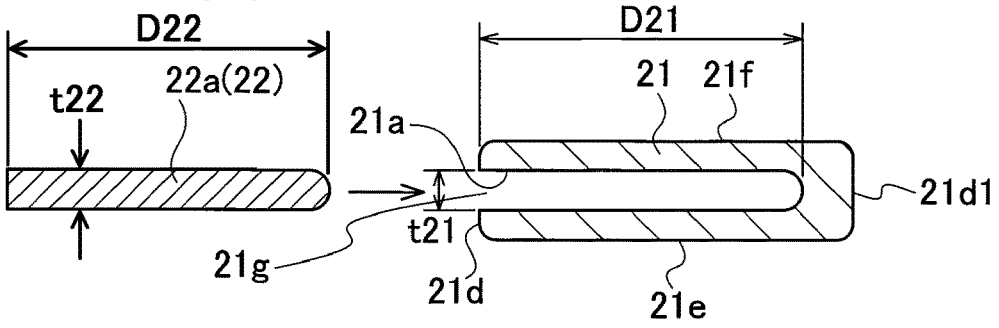
FIG. 3A is a sectional view illustrating a state at the S3*b*-S3*b* position in FIG. 1 before the supporter is attached to a band base portion of a band.
Figure 3B:
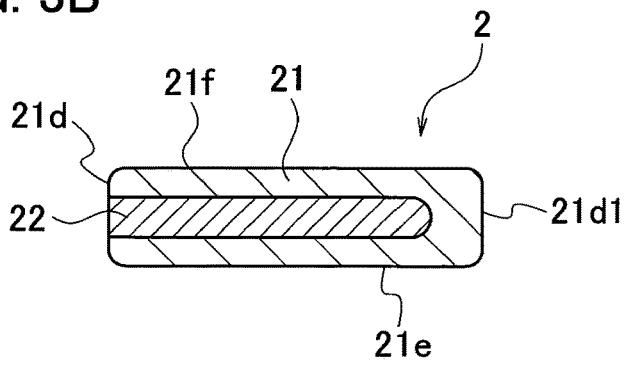
FIG. 3B is a sectional view illustrating a state at the S3*b*-S3*b* position after the supporter is attached.
Figure 4A:
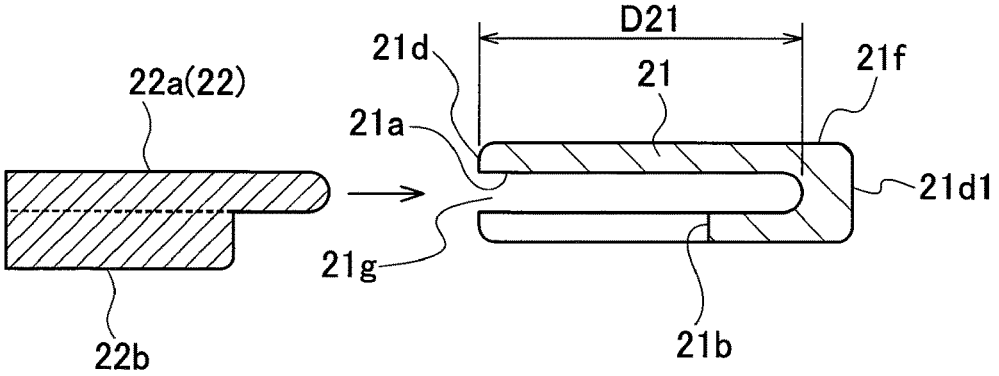
FIG. 4A is a sectional view illustrating a state at the S4*b*-S4*b* position before the supporter is attached to the band base portion of the band.
Figure 4B:
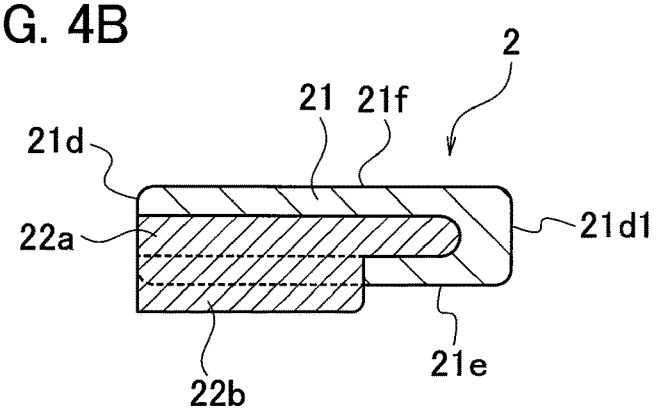
FIG. 4B is a sectional view illustrating a state at the S4*b*-S4*b* position after the supporter is attached.
Figure 5:
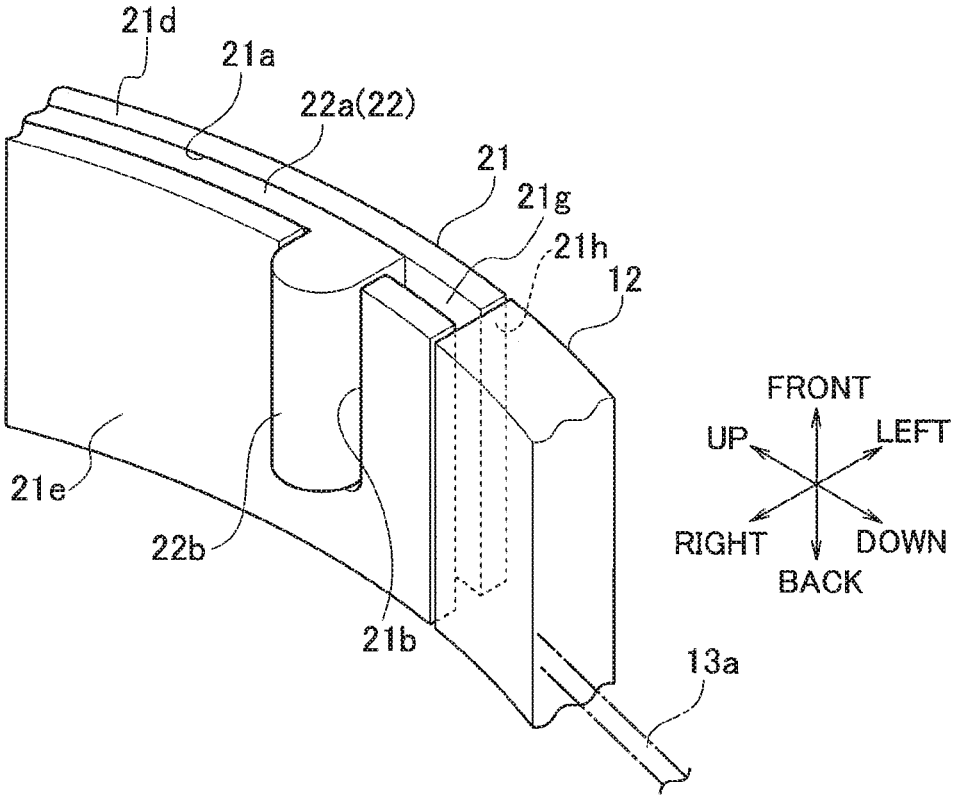
FIG. 5 is a partial perspective view illustrating a part A indicated in FIG. 1 viewed from a side of an inner surface of the band base portion.
Figure 6A:
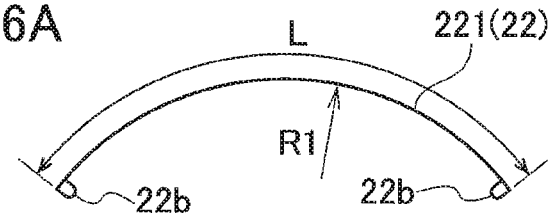
FIGS. 6A, 6B and 6C are schematic diagrams illustrating types (examples) of the supporters.
Figure 6B:
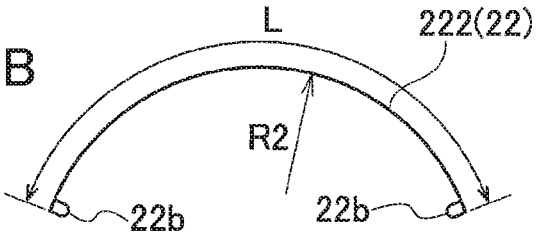

FIGS. 2A, 2B and 2C are a front view, a bottom view and a right side view of the supporter 22, respectively. FIGS. 3A and 3B are sectional views illustrating states ate, the S3*b*-S3*b* position in FIG. 1. FIG. 3A shows the state before the supporter 22 is attached to the band base portion 21. FIG. 3B shows the state after the supporter 22 is attached to the band base portion 21. FIGS. 4A and 4B are sectional views illustrating states at the S4*b*-S4*b* position in FIG. 1. FIG. 4A shows the state before the supporter 22 is attached to the band base portion 21. FIG. 4B snows the state after the supporter 22 is attached. FIG. 5 is a partial perspective view illustrating a part A indicated in FIG. 1 viewed from a side of an inner surface 21*e* of the band base portion 21. FIGS. 6A, 6B and 60 are schematic diagrams illustrating types (examples) of the supporters 22.

The band base portion 21 is a plate-shaped member extending in a longitudinal direction (substantially in a curved direction) of the band base portion 21. The band base portion 21 is formed of rubber, thermoplastic elastomer, or the like to have flexibility. The band base portion 21 has a curved shape (substantially-curved shape) which is maintained in a free state where no external force is applied to the band base portion 21. Both ends of the band base portion 21 are connected with the band connection portions 12 and 12 of the main bodies 1 and 1.

As shown in FIG. 3, the band base portion 21 has a side surface 21*d* located on one side in a width direction of the band base portion 21. Here, the width direction is a direction normal to a plain including the bending direction. The side surface 21*d* is provided with the slit 21*a* opened on the side surface 21*d*. An open in 21*g* of the slit 21*a* extends in the longitudinal direction of the band base portion 21. A depth of the slit extends in the width direction of the band base portion 21.

The band base portion. 21 is thin in a thickness direct on orthogonal to the longitudinal and width directions. Accordingly, with the formation of the slit 21*a*, the band base portion 21 has a U-shaped cross section opened in the width direction.

The extension of the slit 21*a* may reach the both ends 21*h* and 21*h* of the band base portion 21 in the longitudinal direction (see FIG. 5). In this case, the slit 21*a* is formed to connect the both ends 21*h* and 21*h* over the entire in the longitudinal direction. Otherwise, the extension of the slit 21*a* may be terminated at positions near the both ends 21*h* and 21*h*.

As shown in FIG. 4, the band base portion 21 includes a slot 21*b*. The slot 21*b* is formed on an inner surface 21*e* and communicated (connected) with the slit 21*a*. The slot 21*b* extends from the side surface 21*d* toward a side surface 21*d*1 located on an opposite side of the side surface 21*d*. The slot 21*b* is positioned at a position corresponding to a protrusion 22*b* of the supporter 22 as described below, and has a shape complementary to the protrusion 22*b*. For example, as shown in FIG. 5, the slots 21*b* is formed near each of the ends 21*h* and 21*h*.

The band base portion 21 maintains the curved shape in the free state as described above. The band base portion 21 has flexibility at least in a direction in which a deformation of the band base portion 21 varies a curvature itself. The band base portion 21 has a flexural rigidity E21. The flexural rigidity E21 has a value which is insufficient to generate an elastic repulsive force which sufficiently presses the main body 1 against the head H when the band base portion 21 without the supporter 22 is worn on the head H.

The flexural rigidity E21 has the value, which sufficiently transmits an elastic repulsive force of the supporter 22 to the main body 1 in a state where the supporter 22 is attached to the band base portion 21, whereby enabling the main body 1 to generate a good lateral pressure. This value is properly set based on properties of the band base portion 21 such as the shape (e.g. sectional shape), the material and the like.

As shown in FIG. 1, the side surface 21*d* with the slit 21*a* according to the present embodiment is the front surface of the band base portion 21 when using the headphone 91. However, this side surface 21*d* may be the back surface of the band base portion 21 when using the headphone 91. In addition, the slot 21*b* may be formed on an outer surface 21*f* of the band base portion 21 instead of the inner surface 21*e*.

The supporter 22 is a plate-shaped member extending in a longitudinal direction (substantially in a curved direction) of the supporter 22. The supporter 22 extends along with the band base portion 21. The supporter 22 is made of a hard resin or the like to have flexibility. As shown in FIG. 2A, the supporter 22 formed into an arc shape (a curved shape), and has flexibility at least in a direction in which a deformation of the supporter 22 varies a curvature itself. The supporter 22 has the shape and the material that generate a certain degree of elastic repulsive force when the supporter 22 is deformed by an external force in a direction which varies the curvature itself.

The supporter 22 includes the protrusion 22*b*. The protrusion 22*b* protrudes toward an outside of the band base portion 21 through the band base portion 21. The protrusion 22*b* is located at each of the both ends on an inner surface of the supporter 22, and protrudes from the inner surface. For example, as shown in FIG. 2B, the protrusion 22*b* is formed as a rib extending in the width direction. The protrusion 22*b* extends from a side surface 22*c* in the width direction of the supporter 22 at a predetermined length Da. The thickness t22 and the width D22 of the supporter 22 are equal to or slightly smaller than the height t21 of the opening 21*g* and the depth D21 of the slit 21*a* of the band base portion 21, respectively. Therefore, as shown in FIG. 3B, the supporter 22 can be inserted into the slit 21*a* and can be housed almost without gap. When the supporter 22 is inserted into the slit 21*a*, the protrusion 22*b* enters the slot 21*b* of the band base portion 21 (see FIGS. 4A, 4B), and is exposed from the inner surface 21*e* of the band base portion 21 (see FIGS. 4B and 5). The protrusion 22*b* of the supporter 22 projects inward with respect to the inner surface 21*e* of the band base portion 21.

A flexural rigidity (second flexural rigidity) E22 of the supporter 22 is larger than the flexural rigidity (first flexural rigidity) E21 of the band base portion 21. Accordingly, for example, the supporter 22 can be easily attached to the band base portion 21 by bending the band base portion 21 in accordance with the arc shape of the supporter 22 and inserting (fitting) the supporter 22 into the slit 21*a* of the band base portion 21.

For convenience of explanation, FIG. 1 illustrates the side surface 22*d* of the supporter 22 in black, which is attached into the slit 21*a*.

The protrusion 22*b* functions as a catch (or a hold) for a finger or a tool when removing the supporter 22 in the slit 21*a* from the slit 21*a*. Accordingly, a user or the like can easily remove the supporter 22 from the band base portion 21.

By attaching the supporter 22 into the slit 21*a* of the band base portion 21, the band 2 comes to have a flexural rigidity E which is a substantial sum of the flexural rigidity E22 of the supporter 22 and the flexural rigidity E21 of the band base portion 21. Meanwhile, the flexural rigidity E21 of the band base portion 21 only slightly contributes to the flexural rigidity E of the band 2, otherwise it does not contribute substantially. Thus, the flexural rigidity E mainly depends on the flexural rigidity E22 of the supporter 22.

Accordingly, various kinds of supporters 22 having different flexural rigidities E22 may be prepared in advance. In this case, it is possible to change the lateral pressure by selection of one from the supporters 22 with different flexural rigidities E22. Consequently, the headphone 91 can have the comfortable lateral pressure depending on various customers by fitting the supporter 22 having the appropriate flexural rigidity E22, which generates the comfortable lateral pressure when the headphone 91 is worn on the head H of the customer, into the band base portion 21.

Figure 6C:
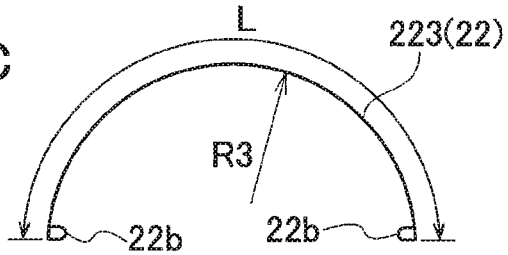

The flexural rigidity E22 of the supporter 22 can be changed by changing the radius R of the curvature if the supporter 22 is formed of the same material with the same sectional shape. For example, FIGS. 6A, 6B and 6C show supporters 221, 222 and 223, respectively. The supporters 221, 222 and 223 have different averaged radii R1, R2 and R3 of curvatures (R3<R2<R1), respectively, but they have the same length L between their ends along their curves. Here, any of the averaged radii R1, R2 and R3 are smaller than the curvature radius of the outer shape of the head H.

It is supposed that any one of the supporters 221, 222 and 223 is fitted into the slit 21*a* of the band base portion 21. In this case, the lateral pressure of the headphone 91 is the smallest when fitting the supporter 221 into the slit 21*a*. Next, the lateral pressure of the headphone 91 when fitting the supporter 222 into the slit 21*a* is larger than that when fitting the supporter 221 into the slit 21*a*. Finally, the lateral pressure of the headphone 91 is the largest when fitting the supporter 223 into the slit 21*a*.

It should be noted that the setting of the flexural rigidity E22 of the supporter 22 is not limited only by changing the averaged radius R of curvature, as described above. Specifically, the flexural rigidity may be changed by various ways such as changing the material or shape (e.g. sectional shape) of the supporter 22.

The headphone 91 includes the band which is constituted of the band base portion 21 and the supporter 22. A preferred lateral pressure can be obtained only with the combination of the band base portion 21 and the supporter 22. Therefore, the headphone 91 not only can adjust the lateral pressure, it also can have a small number of components and satisfactorily suppress the increase of the manufacturing cost.

The band 2 according to the present embodiment has a simple structure, as described above. Therefore, it can avoid an interference with the design of appearances. In other words, the degree of freedom in appearance design of the headphone 91 is not suppressed, and it would rather be higher than that of a conventional headphone. For example, the supporter 22 can be colored with a different color from that of the band base portion 21 as shown in FIG. 1.

An embodiment according to the present disclosure is not limited to that as described above, and may be modified without departing from the scope of the present disclosure.

For example, the cable 13 may be pulled out only from one of the main bodies 1 and 1. In this case, the headphone 91 includes an auxiliary cable 13*a* which is pulled out from one main body 1 and is connected with cable 13 via the band 2 and the other main body 1. The auxiliary cable 13*a* may be an internal cable (not shown) of the cable 13, may be a cable electrically connecting with the internal cable of the cable 13, and may be a cable electrically connecting between one speaker unit SP and another speaker unit SP which is electrically connected with the cable 13, for example.

Figure 7:
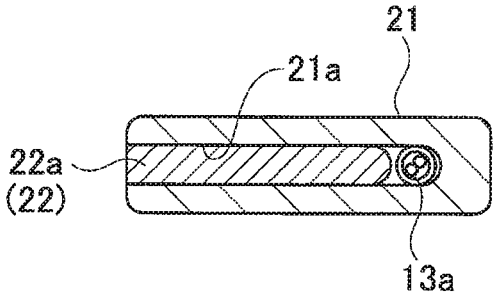
FIG. 7 is a sectional view illustrating a state in which a communication cable is housed in the slit of the band base portion.

As shown in FIG. 7, the auxiliary cable 13*a* is disposed around the bottom of the slit 21*a* of the band base portion 21, and the supporter 22 is housed in the remaining space of the slit 21*a*. here, the supporter 22 has a width which is equal to or less than a value obtained by subtracting the outer diameter of the auxiliary cable 13*a* from the depth D21 of the slit 21*a*.

Since the auxiliary cable 13*a* is invisible from the outside, it does not interfere the appearance of the band 2.

Figure 8:
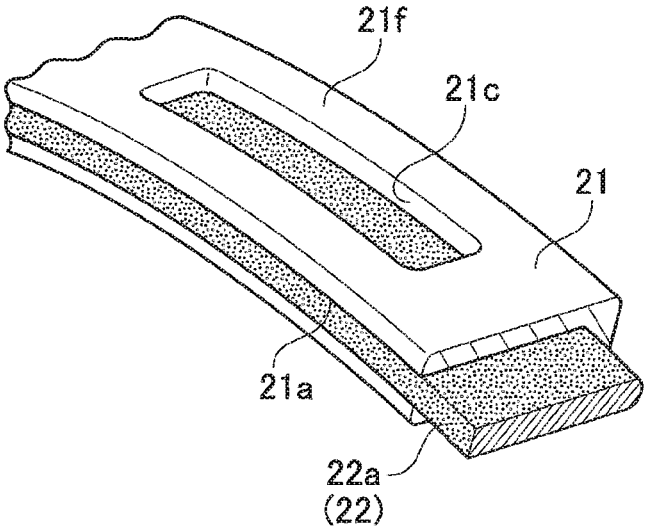
FIG. 8 is a partial perspective view of an example in which a window is provided in the band base portion.

As shown in FIG. 8, the band 2 may include a window 21*c* formed in an outer surface 21*f* of the band base portion 21. The window 21*c* exposes the supporter 22 to the outside of the band base portion 21. Further, the appearance such as color or surface finish of the supporter 22 may be different from that of the band base portion 21. In this case, the supporter 22 can be easily discriminated visually, and the design property can be improved. In addition, it becomes easy to confirm if the supporter 22 is inserted into the slit 21*a*.

Since the flexural rigidity E21 or the band base portion 21 is sufficiently smaller than the flexural rigidity E22 of the supporter 22, the band base portion 21 substantially functions as a housing for the supporter 22. Therefore, even if the window 21*c* is formed in the band base portion 21, no trouble occurs when the headphone 91 is worn on the head H.

The color or surface finish of the supporter 22 may be changed in accordance with the flexural rigidity E22. In this case, it is possible to recognize the flexural rigidity E22 of the supporter 22 attached to the band base portion 21. That is, it is possible to recognize or estimate the lateral pressure to be applied only by the appearance of the headphone 91 even if the headphone 91 is not actually worn. In this case, the formation of the window 21*c* can improve the ease of the recognition or the estimation on the lateral pressure.

Figure 9:
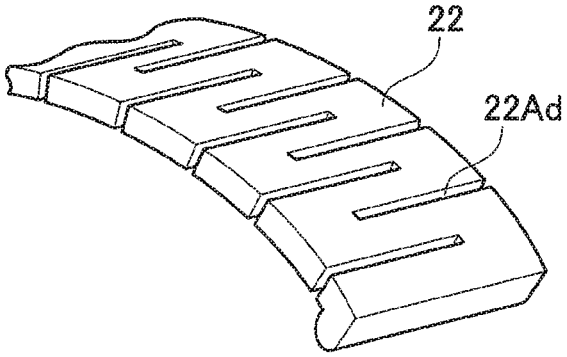
FIG. 9 is a partial perspective view of a modified example of the supporter.

As shown in FIG. 9, the supporter 22A may have slits 22Ad to change (adjust) the flexural rigidity E22 of the supporter 22A itself. For example, the slits 22Ad are alternately staggered along the longitudinal direction of the supporter 22A. The slits 22Ad extend in the width direction of the supporter 22 and may be penetrated or recessed in the thickness direction of the supporter 22A. The slits 22Ad may be opened on corresponding side surface of the supporter 22, or may be terminated at the inside of the supporter 22.

The protrusion 22*b* for the supporter 22 to be detached from the band base portion 21 by a finger or a tool is not limited to the shape and location as shown in FIGS. 2A and 2B. For example, the protrusion 22*b* may be provided a side surface 22*a* of the supporter 22, which is exposed from the opening 22*g* of the slit 21*a*. In this case, the protrusion 22*b* protrudes from the side surface 22*a* in the width direction.

The band 2 of the headphone 91 functions as a headband by attaching the supporter 22 to the band base portion 21. The manufacturer and seller of the headphone 91 can sell the headphone 91 by the following, for example.

A seller prepares a kinds of supporters 22 having different flexural rigidity E22 in advance at a store so that different lateral pressures can be obtained when a customer tries to wear a headphone 91 on a head H of the customer. The selection of the supporter 22 may be made by any of the seller and the customer.

As a trial, the customer actually wears the headphone 91 on the head H every when exchanging the supporter 22 to compare feelings of difference by the lateral pressures. Finally, when the customer finds the supporter 22 with the preferable lateral pressure by the trial, the seller sells the headphone 91 including the supporter 22 giving the preferable lateral pressure, which found by the customer. The headphone 91 may be sold with the supporter 22 attached to the band base portion 21, or may be sold with these separated from one another. The supporter 22 may be sold as a single item. Otherwise, several supporters 22 with different flexural rigidity E22 may be sold for the user to choose the preferable one from them for obtaining the preferable lateral pressure.

What is claimed is:

1. A headband for headphones comprising:

a band base portion formed to have a slit establishing a reduced internal thickness region in a direction of the band base portion orthogonal to longitudinal and width directions of the band base portion, the reduced internal thickness region forming a U-shaped cross section opened and extended in the width direction, the U-shaped cross section opened on a side surface of the band base portion located on a side in the width direction, the band base portion having a first flexural rigidity; and a supporter detachably attached into the slit, formed into an arc shape and having a second flexural rigidity greater than the first flexural rigidity.

2. The headband according to claim 1, wherein the supporter includes a protrusion protruding toward an outside of the band base portion through the band base portion.

3. The headband according to claim 1, wherein the supporter and the band base portion have appearances with mutually different colors.

4. The headband according to claim 1, wherein the supporter and the band base portion have appearances with mutually different surface finishes.

5. The headband according to claim 1, wherein the band base portion includes an outer surface provided with a window exposing the supporter to an outside of the band base portion.

6. A headphone comprising:

main bodies each housing a speaker unit; and a headband according to claim 1, linking between the main bodies.

7. The headband according to claim 1, wherein a width of the supporter along the width direction of the band base portion is equal to or smaller than a depth of the slit along the width direction of the band base portion.

8. A headband for headphones comprising: a band base portion having a first flexural rigidity, including a slit establishing a reduced internal thickness region, forming a U-shaped cross section, with the slit opened on a side surface of the band base portion located on one side in a width direction of the band base portion normal to a plane including a bending direction of the band base portion, the slit extending in a longitudinal direction and the width direction of the band base portion; and a supporter detachably attached into the slit, formed into an arc shape and having a second flexural rigidity greater than the first flexural rigidity.

9. The headband according to claim 8, wherein the supporter includes a protrusion protruding toward an outside of the band base portion through the band base portion.

10. The headband according to claim 8, wherein the supporter and the band base portion have appearances with mutually different colors.

11. The headband according to claim 8, wherein the supporter and the band base portion have appearances with mutually different surface finishes.

12. The headband according to claim 8, wherein the band base portion includes an outer surface provided with a window exposing the supporter to an outside of the band base portion.

13. A headphone comprising:

main bodies each housing a speaker unit; and a headband according to claim 8, linking between the main bodies.

14. The headband according to claim 8, wherein a width of the supporter along the width direction of the band base portion is equal to or smaller than a depth of the slit along the width direction of the band base portion.

* * * * *